United States Patent [19]

Wood

[11] 4,330,267

[45] May 18, 1982

[54] KILN CAR

[75] Inventor: Russell K. Wood, Morrisville, Pa.

[73] Assignee: American Standard Inc., New York, N.Y.

[21] Appl. No.: 207,569

[22] Filed: Nov. 17, 1980

[51] Int. Cl.[3] ..... F27D 1/12; F27B 9/26

[52] U.S. Cl. ..... 432/241; 432/137

[58] Field of Search ..... 432/241, 137

[56] References Cited

U.S. PATENT DOCUMENTS 1,473,152 11/1923 Lillibridge ..... 432/241

3,759,661 9/1973 Barsby ..... 432/241

*Primary Examiner*—John J. Camby

*Attorney, Agent, or Firm*—James J. Salerno, Jr.; Robert G. Crooks; John P. Sinnott

[57] ABSTRACT

A kiln car which permits a substantial increase of product throughput per car per day through a kiln is disclosed. The kiln car includes a carriage for conducting the car through the kiln and a superstructure made of reduced mass of dense refractory components. A lower load-bearing base is arranged and constructed so that the load-bearing surface lies in a plane below the plane of the bench of the kiln to provide an increased cross-sectional area for product firing. The low-mass, load-bearing base includes a plurality of spaced, parallel, dense, refractory blocks which are resistant to thermal shock and capable of withstanding temperatures of about 1300° C., and are positioned transversely on the carriage. Each block is formed having aligned and spaced bores or sockets for mounting a column of dense refractory in each bore. A plurality of elongated, dense, refractory members or spacers are positioned around the perimeter, and are mounted between the parallel-spaced, refractory blocks to lock the blocks in place. Dense, refractory, product-supporting members are disposed in spaced, parallel relation and are supported by the parallel-positioned, refractory blocks to provide a product-supporting surface. A low density low heat capacity, refractory material is interspersed between the parallel-spaced, refractory blocks below the product-supporting members to provide a base of low mass having reduced thermal conductivity, so that heat damage to the carriage assembly, including the wheels and bearings, is obviated.

8 Claims, 6 Drawing Figures

KILN CAR

RELATED APPLICATION

Co-pending Application of Dr. Joao F. G. Molina, Ser. No. 204,504, filed Nov. 17, 1980, for "Kiln Car".

BACKGROUND OF THE INVENTION

1. Field of the Invention

The present invention is directed to an improved kiln car for transporting an increased throughput of product through a kiln and, more particularly, to a kiln car having a refractory superstructure of reduced mass and improved thermal barrier means of low heat capacity to prevent heat damage to the carriage of the kiln car, and to permit more efficient use of energy in the kiln while increasing the product throughput per car per day.

2. Review of the Prior Art

Kiln cars presently employed and/or described in the prior art use a steel carriage adapted to be mounted on a track for rolling the kiln car through a high temperature kiln; for example, a tunnel kiln. Mounted on the carriage are refractory materials sufficiently large and of a high mass and forming a solid base to support the setting refractories or product to be fired, to provide a thermal barrier for the steel carriage, so that the bearings and other moving parts are not affected by the heat. To improve the thermal barrier means, the spaces between the steel "I" beams of the carriage are filled with various insulating materials, such as described in U.S. Pat. No. 1,306,160. In U.S. Pat. No. 1,333,381, a specially designed kiln car is described having a superstructure in which the heated atmosphere circulating in the kiln is brought into direct contact with the product to be fired but also protects the product from the direct impact of the heat being introduced into the kiln. In U.S. Pat. No. 1,587,210, a kiln car for use in a tunnel kiln is described in which the car superstructure includes a specially designed imperforate layer made of a ceramic-bonded silicon carbide or crystalline alumina on which ware to be fired can be placed without the use of saggers. In U.S. Pat. No. 1,694,749, a kiln car is described in which the superstructure is arranged with shelves or trays which may be adjusted to varying heights to suit articles of various heights. In U.S. Pat. No. 1,777,856, a kiln car is described in which a layer of refractory bricks are placed on the steel carriage to provide an insulating barrier. In U.S. Pat. No. 2,879,577, an improved superstructure having horizontally-spaced shelves, supported by pillars, is described. In U.S. Pat. No. 3,377,670, an improved car top tile for kiln trucks is described. In U.S. Pat. No. 3,759,661, a low thermal mass kiln car is described in which nonload-bearing, thermal-insulating material forms part of the refractory superstructure. A plurality of posts for carrying an upper deck to support ware to be fired are mounted on the carriage of the kiln car and project upwardly through the thermal barrier. The posts are supported with lateral stability by sockets formed in the base. In U.S. Pat. No. 3,997,289, a kiln car is described having a refractory superstructure formed of a number of tiers one above the other, each being supported by refractory batts. From the foregoing, the concerns of the prior art included providing kiln car superstructures with sufficient refractory mass to prevent damage to the carriage. Also various attempts to reduce the mass of refractory by using thermal-insulating materials have been made. However, the problem of providing a refractory superstructure having sufficiently reduced heat conductivity to the steel carriage structure remains. Also, present refractory superstructures do not provide for an increase in throughput of product per car per day through a kiln with a resulting reduction of energy per piece fired.

SUMMARY OF THE INVENTION

It is therefore an object of the present invention to provide a kiln car which permits an increase of throughput of product per car per day through a high temperature kiln, while substantially reducing the amount of energy for firing each piece of product.

Another object of the invention is to provide an improved kiln car of low mass, so that the ratio of the weight of the car compared to the weight of the product processed is reduced approximately by half.

Another object of the invention is to provide a low-mass superstructure for a kiln car in which the load-bearing base is arranged and constructed of dense, refractory components of reduced mass so that the load-bearing surface of the base lies in a plane below the plane of the bench of the kiln to provide an increased cross-sectional area for product firing.

Another object of the invention is to provide a kiln car having a superstructure of reduced refractory mass, an increased throughput load capacity per car per day, which can be moved through the kiln at an increased speed, so that additional kiln cars can be utilized in a 24-hour period, thereby increasing the throughput of product resulting in improved kiln efficiency.

Another object of the invention is to reduce product spoilage by providing a kiln car superstructure in which excessive weight of refractory to be heated and cooled is eliminated, which permits closer control of the rate of heating of the product in the preheat section of the kiln and controlled cooling of the product.

Another object of the invention is to provide a low maintenance kiln car, having a superstructure of reduced thermal conductivity, which prevents excessive heat transfer from the refractory components to the wheels, bearings and other moving parts of the carriage of the kiln car.

Another object of the invention is to provide a kiln car which will increase the capacity of product fired in a kiln per day, which reduces fuel requirements per pound of product fired by reducing the weight of the refractory forming the superstructure of the kiln car, thereby reducing the cost of product firing and increasing the efficiency of kiln operation.

From the foregoing objectives, the invention generally contemplates providing a kiln car which will substantially increase throughput of product per car per day through a high temperature kiln. The kiln car includes a steel carriage assembly having wheels cooperating with a track for rolling the kiln car through a kiln, such as a tunnel kiln. Mounted on the upper steel surface of the carriage, is a layer of insulating refractory. An improved refractory superstructure of low mass, having a lower load-bearing base, is mounted on the insulating refractory and includes a plurality of spaced, parallel, dense, refractory blocks which are resistant to thermal shock and capable of withstanding temperatures of about 1300° C., and are positioned transversely on the carriage, with each block having a bore or socket for mounting a column of dense refractory therein. A plurality of elongated spacer blocks of dense refractory are positioned between the parallel spaced refractory blocks to lock the blocks in fixed position and to form a perimeter of refractory blocks. Dense refractory supporting members are disposed in spaced, parallel relation and are supported by the parallel-positioned refractory blocks to provide a product-supporting surface. A low density, low heat capacity refractory material is interspersed between the parallel-spaced refractory blocks and below the product-supporting members to provide a low-bearing base of low mass, having reduced heat conductivity. Additionally, an upper load-bearing deck or base of dense refractory may be supported on the refractory columns mounted in the sockets of the spaced, parallel refractory blocks.

DESCRIPTION OF THE PREFERRED EMBODIMENT

Figure 1:
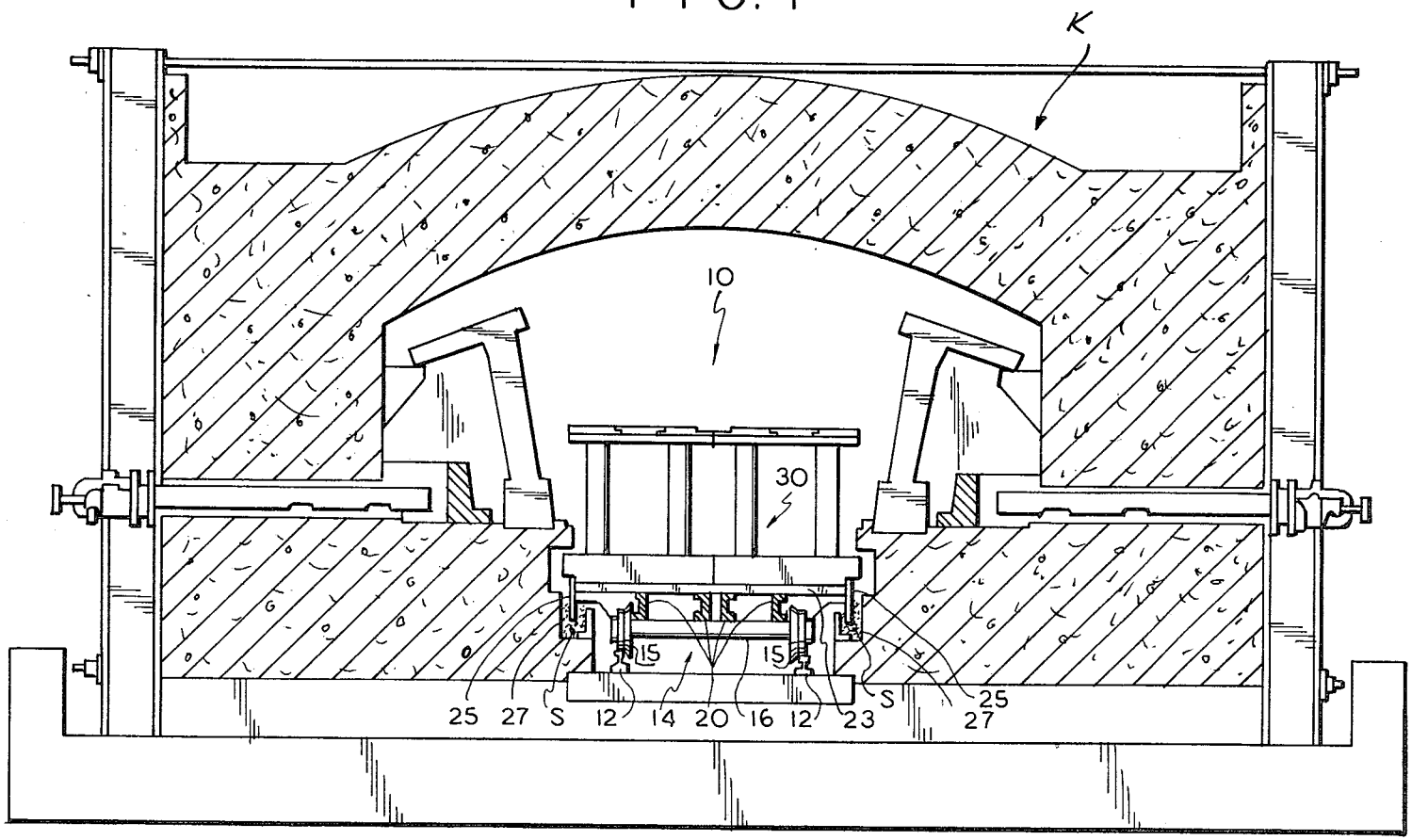
FIG. 1 is a sectional view in elevation, illustrating the kiln car passing through a tunnel kiln in which the lower load bearing base lies in a plane below the plane of the bench of the kiln.

Kiln car 10, illustrated in FIG. 1, is depicted as it traverses through a high temperature kiln K of the tunnel type. Kiln car 10 is mounted for movement along track 12 by carriage assembly 14. Carriage assembly 14 includes front wheels 15 and axle 16, and a similar rear wheel and axle assembly, not shown, which are coupled together by spaced steel beams 20. Transversely spaced angle irons 23, positioned parallel to each other, provide rectangular-formed sections in which steel plates 22 are welded to form the upper surface for mounting the low-mass, low heat capacity, load-bearing base of dense refractory. Welded along each longitudinal side of carriage assembly 14, are depending side rails 25. Side rails 25 extend into longitudinal slots 27 of tunnel K, wich is filled with sand "S", to form a seal so that the heat from the kiln will not pass between the walls of the kiln and kiln car 10. This prevents damage to the moving parts of the carriage assembly 14, such as the bearings and wheels.

Figure 2:
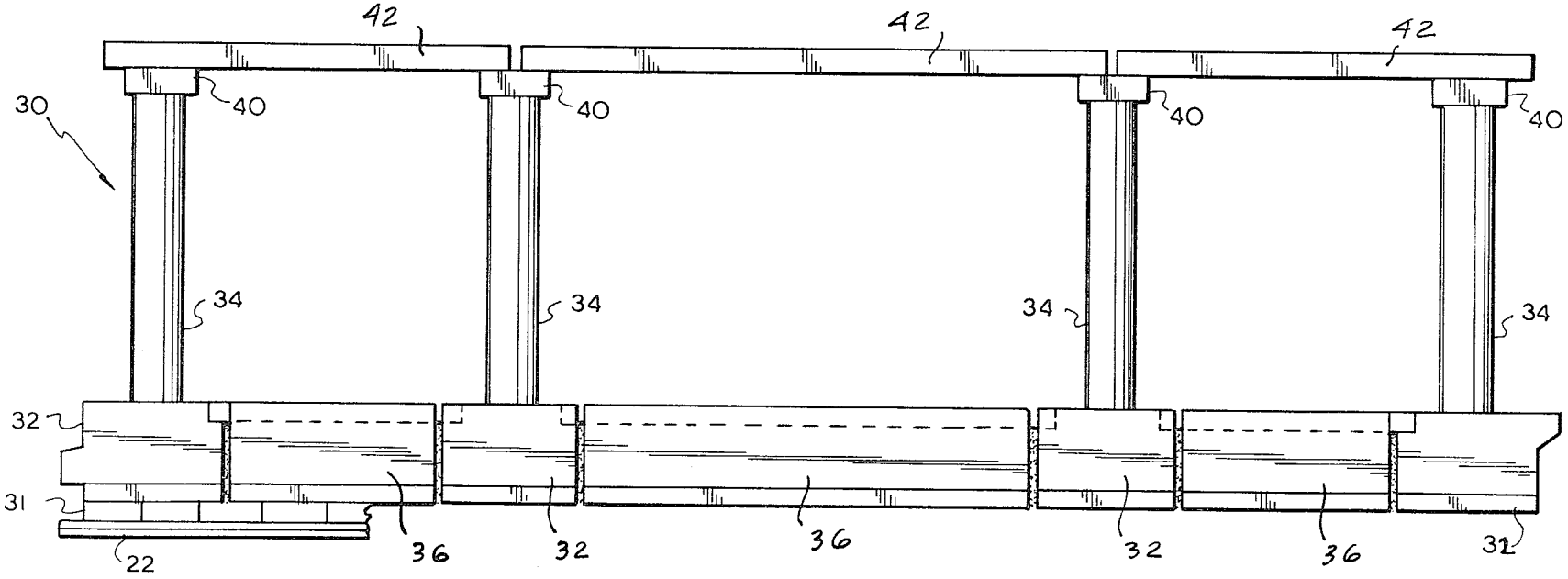
FIG. 2 is a side elevational view of the kiln car of the present invention, with the steel carriage not shown.
Figure 3:
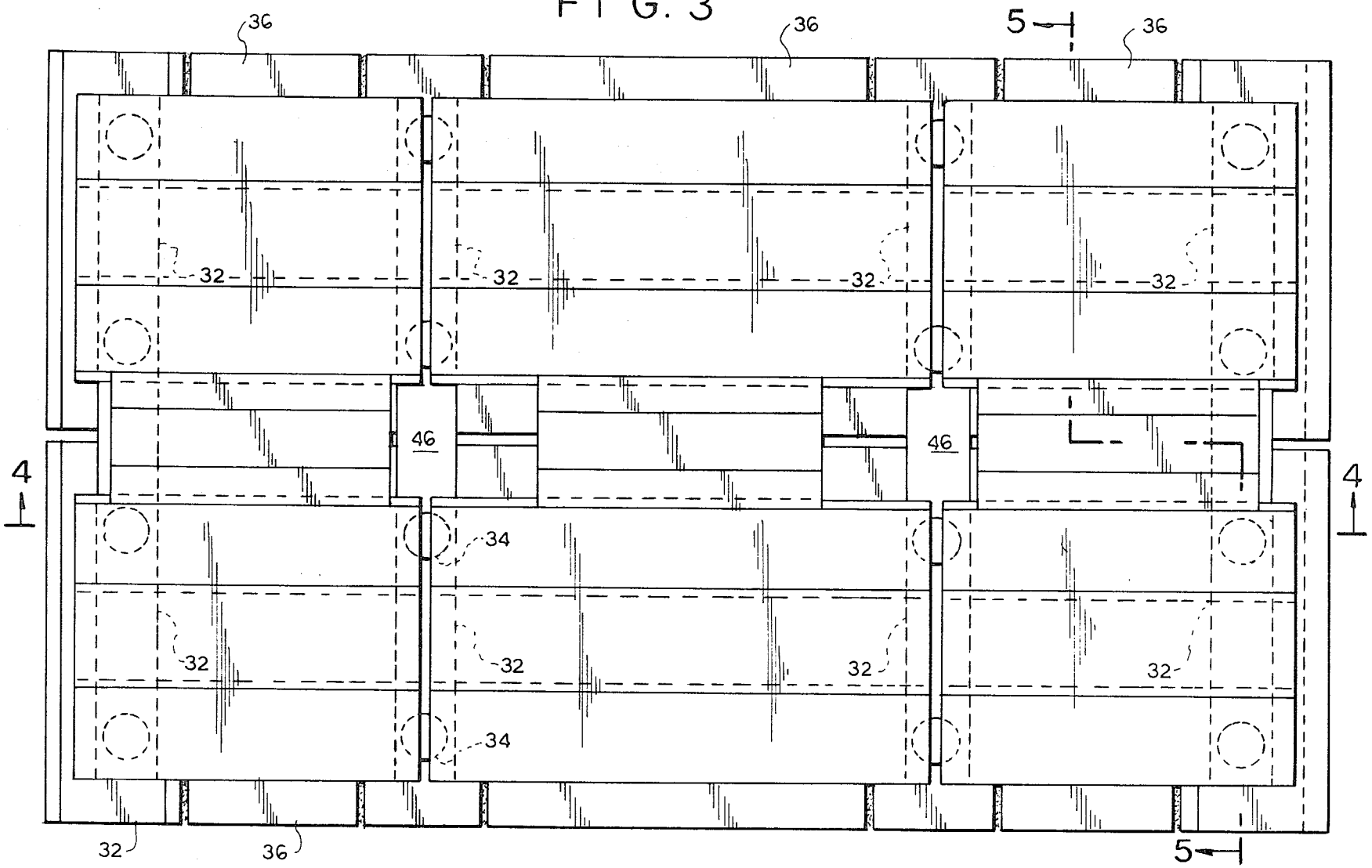
FIG. 3 is a view of the top deck in plan.
Figure 4:
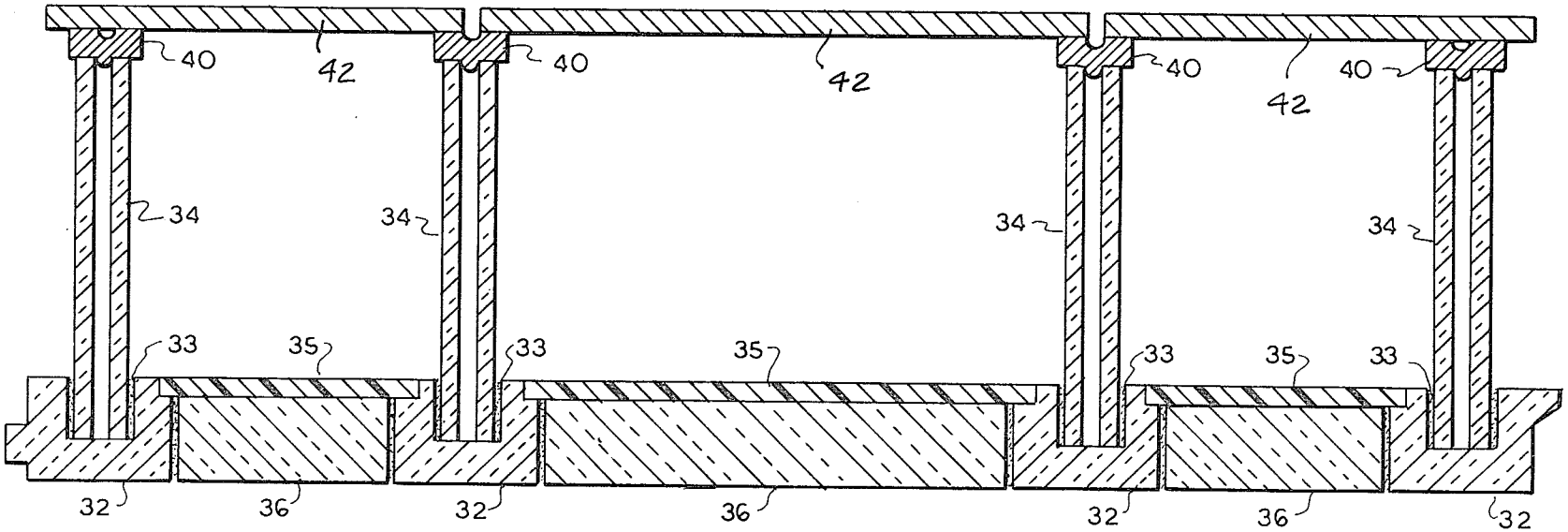
FIG. 4 is a side elevational view, partly in section, taken along the lines 4—4 of FIG. 3.
Figure 5:
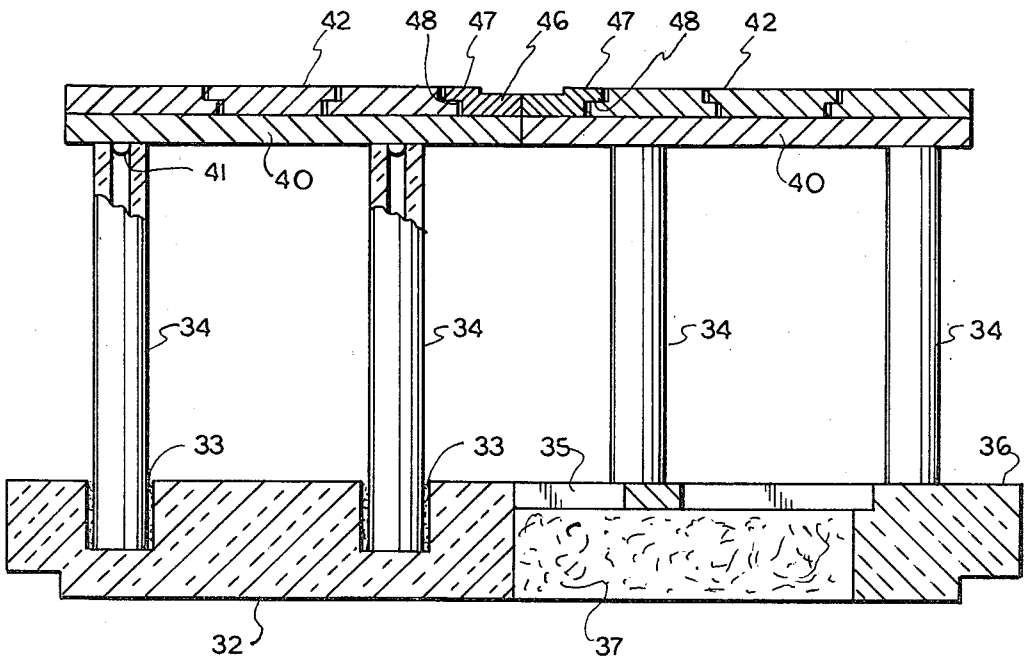
FIG. 5 is a side elevational view, partly in section, taken along lines 5—5 of FIG. 3.
Figure 6A:
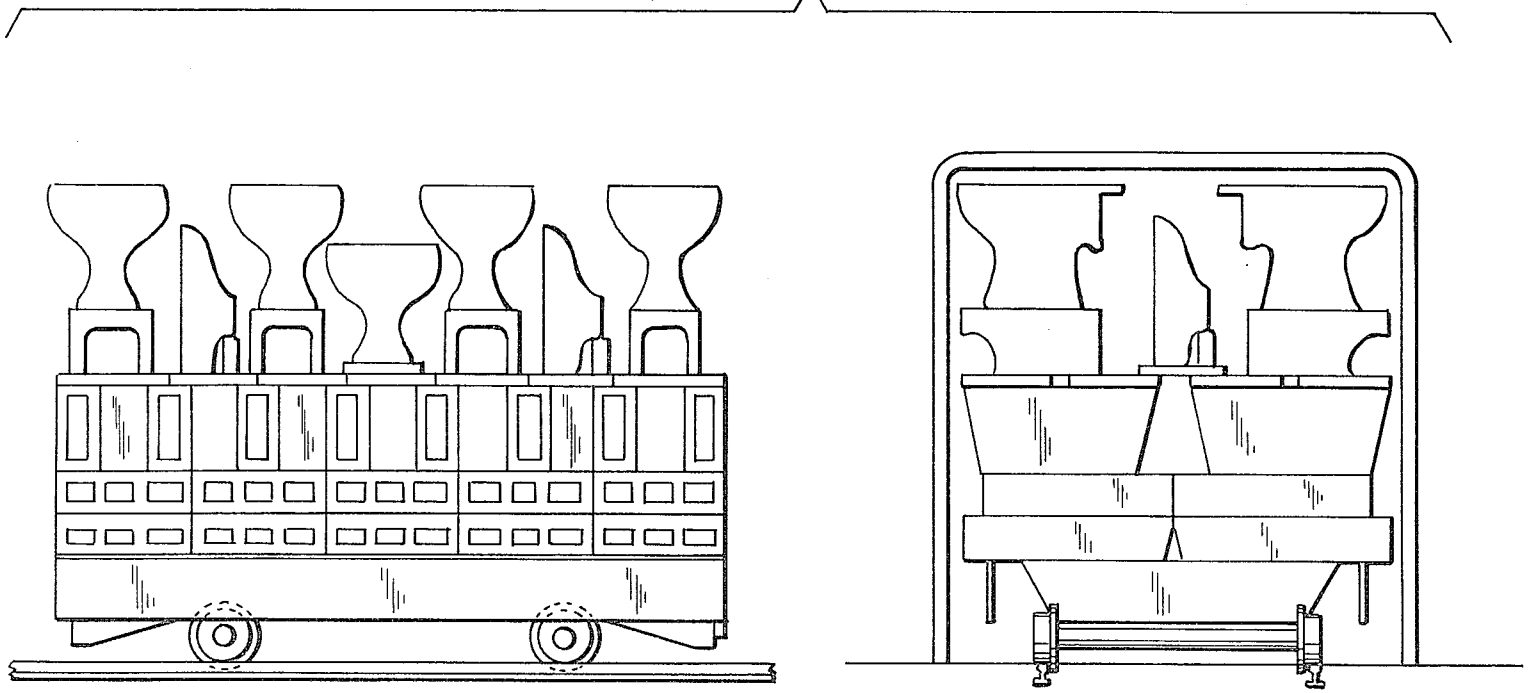
FIG. 6A PRIOR ART
FIGS. 6A and B are pictorial representations of the loading of a commercial kiln car as compared to the loading of the kiln car of the present invention in the same tunnel kiln.
Figure 6B:
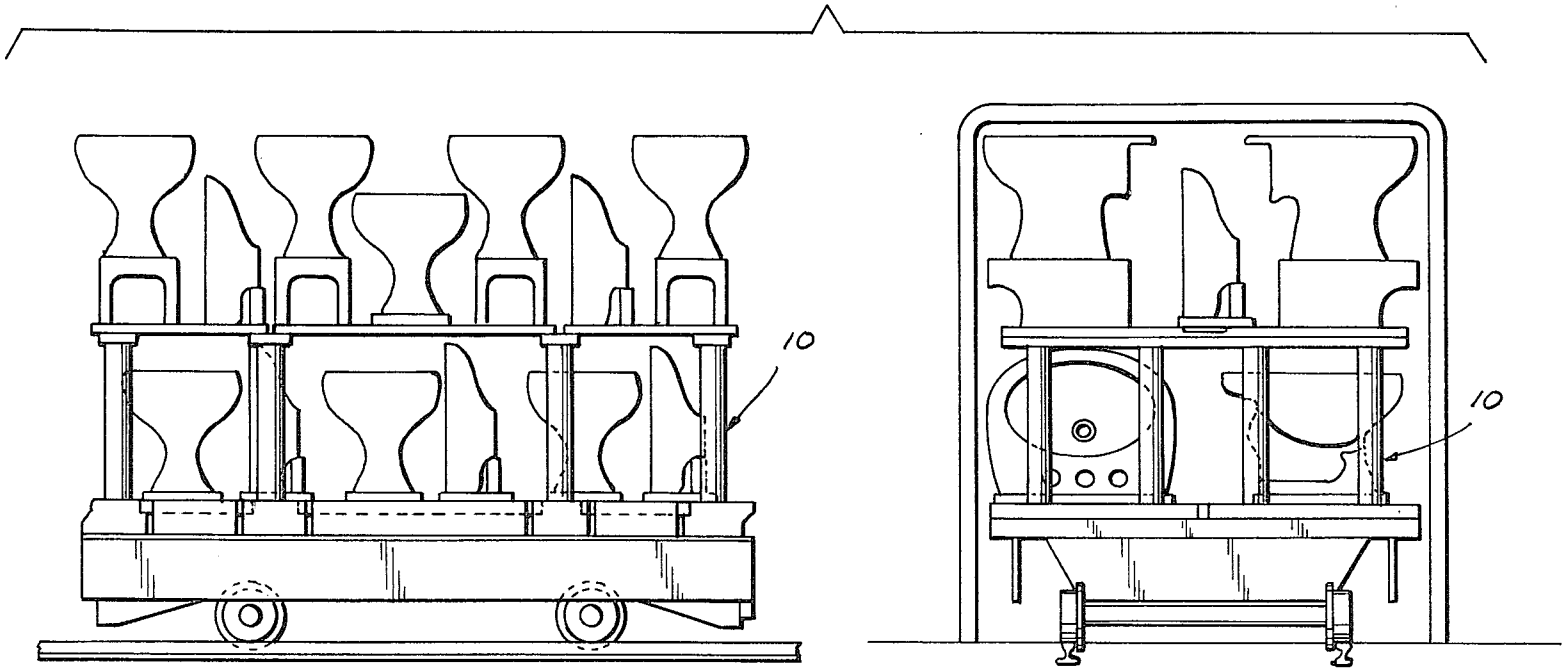

FIGS. 2 through 5 illustrate the various component parts which make up low-mass superstructure 30 of dense refractory. A layer of insulating refractory 31, such as insulating refractory bricks, is mounted on steel plates 22 to provide a thermal barrier between carriage assembly 14 and superstructure 30. As shown in FIGS. 2, 4 and 5, dense refractory blocks 32, each having a plurality of aligned sockets 33 for receiving a column 34 of dense refractory, are transversely spaced in parallel relation on insulating refractory 31. Refractory blocks 36 are positioned between refractory blocks 32 along each side of carriage 14 to form a perimeter of dense refractory. Each refractory block 32 and spacer block 36 is made of dense refractory, which is resistant to thermal shock and capable of withstanding temperatures of more than 1300° C. Product-supporting members 35, such as silicon carbide stringers, are positioned in parallel relation between the transversely-mounted refractory blocks 32 and are supported thereon to form a platform on which product to be fired is placed. A low density, low heat capacity, thermal-insulating material 37, for example: FIBERFRAX, an Alumina-Silica fiber, manufactured by Carborundum Company; Kaowool, manufactured by Babcock and Wilcox; inswool, manufactured by A. P. Green Refractories; and like materials, is disposed in the spaces between the transversely spaced, refractory blocks 32 and product-supporting members 35 of the low-mass, lower, load-bearing base.

Columns 34 are made of dense refractory, such as silicon carbide, mullite or the like, and are tubular in cross section. Each column 34, as illustrated in FIGS. 2, 4 and 5, is mounted in socket 33 of refractory block 32. The space between column 34 and socket 33 is filled with refractory fiber 37 or granular refractory. Silicon carbide stringers 40 are provided with stops 41 to mount stringers 40 in fixed position, as shown in FIGS. 4 and 5, to form four, transverse, parallel rows for supporting silicon carbide deck stringers 42 thereon. As illustrated in FIGS. 3, 4 and 5, the upper load-bearing base is formed having three product supporting sections along the right and left sides thereof, each section having three stringers 42 which are interleaved. Silicon carbide plate 46 is mounted between deck stringers 42 for carrying additional product to be fired. The innermost stringer 42 has longitudinal-extending flanges 48 which nest in corresponding steps 47 of plate 46 to form a lap joint.

In operation, the throughput of product through a tunnel kiln of the kiln car of the present invention was compared to the throughput of product by a typical, commercially-available kiln car of the stringer-girder type. The commercially-available kiln car comprises a carriage assembly 86" long and is of similar design to carriage assembly 14. The refractory superstructure is of a different design and has only a single load-bearing base for firing product to proceed through tunnel kiln K. The refractory superstructure is made up of car blocks, stringers and girders. Refractory car blocks, approximately 10" high, are interlocked together and rest on the 86" long, steel carriage assembly. On the car blocks, laterally spaced and positioned parallel to each other, are placed 10 refractory girders, 5 on each side, to form two rows. Each girder is made of Sillimanite, a dense refractory, and measures 26"×6"×9.5". Silicon carbide stringers are placed longitudinally on the girders and are spaced to accommodate the product to be fired. Each stringer measures 41"×5"×1.5". The overall height of the car is about 33.5" from the track to the top of the stringers. The total weight of the car blocks, girders, stringers and the product to be fired is 4460 lbs. The kiln car will accommodate 19 pieces of product, normally 10 bowls and 9 tanks, having an average fired weight of about 900 lbs. Therefore, to fire 900 lbs. of fired chinaware, requires 3560 lbs. of refractories for a ratio of 3.96 lbs. of refractories to 1 lb. of china.

The kiln car of the present invention measures 86" in length and 54" in width. The large car blocks and girders of the stringer-girder car are replaced by smaller, dense, refractory blocks, insulating refractory bricks and low-density, low heat capacity, insulating material to substantially decrease the mass of the lower load-bearing base of the superstructure of the present invention. Insulating refractory bricks, approximately 2"

thick, are placed on the top of carriage assembly 14. Four rows, made up of eight, dense, refractory blocks of reduced mass, are mounted in position transversely on the insulating refractory brick. Each of the dense, refractory blocks 32 measure 26.5" in length, 5.4" in width and 5.9" in height, and is formed having a socket for mounting a mullite or other refractory material, column therein, which measures 21.5" in length and 3.0" in diameter. Spacer blocks 36 are of two types: the shorter blocks measuring 12.0" in length, 9.0" in width and 5.9" in height; the longer blocks measuring 26.0" in length, 9.0" in width and 5.9" in height. These blocks are used to interlock transversely-spaced blocks 32 and form a perimeter. Product-supporting members are mounted between transversely-spaced blocks 32 and are of two types: the shorter measuring 14" in length, 3" in width and 1" in thickness and the longer block measuring 28" in length, 3" in width and 1" in thickness.

The space within the perimeter of refractory blocks 32 and 36 is filled with a low-density, low heat capacity, insulating material 37, such as FIBERFRAX, an Alumina-Silica fiber, to complete the lower load-bearing base of low mass and low heat capacity. From the top surface of the lower load-bearing base to the top of the track, is 17.5", a difference of approximately 16" in height from that of the commercially-available stringer-girder kiln car. As a result of the difference in height, the lower load-bearing base lies in a plane below the bench of the kiln of about 5", thereby providing an increased cross-sectional area for product firing. The increased cross-sectional area of the kiln permits the use of an upper load-bearing base to accommodate an increased number of product to be fired in a single pass through the kiln, as illustrated in FIG. 5B. The second tier or upper load-bearing base measures 82" in length, 48" in width and is 38.5" from the top of the track, thereby providing a 25" space to accommodate additional product to be fired through the kiln. The upper load-bearing base is supported by tubular columns 34, as illustrated in FIG. 5B, of silicon carbide, mullite, or other refractory material, measuring 21.5" in length and 3" in diameter. By providing both an upper and lower load-bearing base, an additional quantity of product can be fired, increasing the number of pieces fired from 19 to 27 pieces of product, having an average total weight of 1215 lbs. and the total weight of refractories being 2800 lbs., a ratio of 2.30 of refractories to each pound of china is obtained: a reduction of refractories to china of more than 42% that of the commercially-available, stringer-girder kiln car.

The low-mass kiln car of the present invention has a reduced weight of refractories of 764 lbs., compared to that of the stringer-girder kiln car, and is capable of firing 27 pieces of china and provides an increase in weight of product fired per car of 360 lbs., as compared with 19 pieces (855 lbs. total) in the conventional stringer-girder kiln car. The cycle of use per day of the kiln car of the present invention is increased due to the reduction in total weight of refractories per car, because less time is required to heat and cool the refractory of the kiln car. The speed of cars passing through the kiln per day is increased from 50 cars of the stringer-girder type to 60 cars of the present invention, with an attendant increase of more than 12,150 lbs. of product fired due to speed increase alone. All of these improvements increase the efficiency of the use of each kiln car and of the kiln. Also, the firing of an increased number of china pieces reduces fuel consumption per piece of chinaware fired from 2800K cal./kg. of chinaware to 1940K cal./kg. of chinaware, a 31% decrease in energy consumption per day.

What is claimed:

1. In a kiln car having a carriage assembly including wheels for transporting the kiln car and product to be fired through a high temperature kiln, said kiln having a bench therein; a dense refractory superstructure of reduced mass mounted on said carriage assembly, a layer of insulating refractory forming a thermal barrier mounted on the upper surface of said carriage assembly, on which said superstructure is mounted; a load-bearing base of dense refractory of reduced mass and low heat capacity, having product-supporting means to provide a load bearing surface, the plane of which is adapted to lie below the plane of the bench of said kiln, to provide an increased cross-sectional area for product firing; the improvement comprising:

said load-bearing base including a plurality of reduced mass, dense, refractory blocks mounted transversely on said insulating refractory in spaced, parallel relation and having means for supporting an upper load-bearing base;

a plurality of spacer blocks disposed between said parallel, spaced blocks in interlocked relation and forming a perimeter of refractories around said carriage assembly;

a low density, low heat capacity, thermal-insulating material is positioned interiorly of said perimeter of refractory blocks, filling the spaces between said refractory blocks and said product-supporting means to form a load-bearing base of reduced mass and low heat capacity.

2. The kiln car of claim 1, wherein said product support means is a dense, refractory plate supported between said transversely-spaced, refractory blocks and spaced from said insulating bricks.

3. The kiln car as set forth in claim 1, wherein said transverse, dense, refractory blocks are formed having a socket therein for mounting said support means.

4. The kiln car as set forth in claim 2, wherein said support means is a tubular column of dense refractory.

5. The kiln car as set forth in claim 3, wherein said tubular column is mullite.

6. The kiln car of claim 1, wherein said low density, low heat capacity, thermal-insulating material is in the form of an alumina fiber.

7. The kiln car of claim 1, wherein said perimeter of refractory blocks include an outwardly-extending horizontal flange, forming a longitudinally-extending rail to provide a barrier to prevent heat from circulating around said carriage assembly.

8. In a kiln car having a carriage assembly including wheels for transporting the kiln car and product to be fired through a high temperature kiln, said kiln having a bench therein; a dense refractory superstructure of reduced mass mounted on said carriage assembly, a layer of insulating refractory forming a thermal barrier mounted on the upper surface of said carriage assembly, on which said lower load bearing base is mounted; a lower load-bearing base of dense refractory of reduced mass and low heat capacity, having product-supporting means to provide a load-bearing surface, the plane of which is adapted to lie below the plane of the bench of said kiln, to provide an increased cross-sectional area for product firing; the improvement comprising said lower load-bearing base including a plurality of reduced mass, dense, refractory blocks mounted transversely on said insulating refractory in spaced, parallel relation;

an upper load-bearing base having support means mounted on said lower load-bearing base;

a plurality of spacer blocks disposed between said parallel, spaced blocks in interlocked relation and forming a perimeter of refractories around said carriage assembly;

a low density, low heat capacity, thermal-insulating material is positioned interiorly of said perimeter of refractory blocks, filling the spaces between said refractory blocks and said product-supporting means to form a lower load-bearing base of reduced mass and low heat capacity;

said transversely-spaced blocks having spaced, aligned sockets formed therein;

said upper load-bearing base supporting means including a plurality of tubular columns of dense refractory mounted in said socket; and a plurality of product-supporting plates mounted on said tubular columns to form said upper load-bearing base.

* * * * *